US007631790B2

(12) United States Patent
Braams

(10) Patent No.: US 7,631,790 B2
(45) Date of Patent: Dec. 15, 2009

(54) FLUID DISPENSING ACCESSORY

(75) Inventor: John Braams, Chiswick (AU)

(73) Assignee: Concept Express Pty Ltd, New South Wales (AU)

( * ) Notice: Subject to any disclaimer, the term of this patent is extended or adjusted under 35 U.S.C. 154(b) by 435 days.

(21) Appl. No.: 10/544,502

(22) PCT Filed: Feb. 10, 2004

(86) PCT No.: PCT/AU2004/000139

§ 371 (c)(1),
(2), (4) Date: Aug. 4, 2005

(87) PCT Pub. No.: WO2004/071676

PCT Pub. Date: Aug. 26, 2004

(65) Prior Publication Data

US 2006/0049219 A1 Mar. 9, 2006

(30) Foreign Application Priority Data

Feb. 11, 2003 (AU) ..... 2003900623

(51) Int. Cl.
*B65D 35/38* (2006.01)

(52) U.S. Cl. ..... 222/571; 222/568; 222/567; 222/527

(58) Field of Classification Search ..... 222/213, 222/189.09, 633, 320, 571, 527, 568, 570, 222/326, 567; 239/333, 602
See application file for complete search history.

(56) References Cited

U.S. PATENT DOCUMENTS

| | | | | | |
|---|---|---|---|---|---|
| 2,754,033 | A * | 7/1956 | Etter | 222/326 |
| 2,755,003 | A * | 7/1956 | Sherbondy | 222/327 |
| 3,140,052 | A * | 7/1964 | McCuiston | 239/327 |
| 3,658,213 | A * | 4/1972 | Plumer | 222/326 |
| 4,009,804 | A | 3/1977 | Costa et al. | |
| 4,187,960 | A * | 2/1980 | Bonk | 222/107 |
| 4,296,071 | A * | 10/1981 | Weiss et al. | 73/864.11 |
| 4,382,530 | A * | 5/1983 | Calisto | 222/567 |
| 4,572,409 | A | 2/1986 | Finnegan | |
| 4,634,023 | A * | 1/1987 | Tanaka et al. | 222/105 |
| 5,439,178 | A * | 8/1995 | Peterson | 239/333 |
| 5,529,225 | A | 6/1996 | Chang | |
| 6,029,856 | A * | 2/2000 | Jackman | 222/82 |
| 6,076,712 | A * | 6/2000 | Esber et al. | 222/527 |
| 6,578,737 | B2 * | 6/2003 | Jackman | 222/1 |
| 7,014,079 | B2 * | 3/2006 | Swann | 222/570 |
| 2005/0029314 | A1 * | 2/2005 | Williams et al. | 222/527 |

FOREIGN PATENT DOCUMENTS

| | | | |
|---|---|---|---|
| GB | 2210412 | * | 7/1989 |

* cited by examiner

*Primary Examiner*—Kevin P Shaver
*Assistant Examiner*—Robert K Nichols, II
(74) *Attorney, Agent, or Firm*—Connolly Bove Lodge & Hutz LLP

(57) ABSTRACT

A nozzle for a caulking gun incorporates a resilient portion that is compressed when the trigger of the caulking gun is actuated and resumes its former shape when the trigger is released to expand the internal volume of the nozzle. In one embodiment a resiliently compressible insert is mounted within a conventional nozzle and the insert has a hollow body which has an inlet facing the nozzle inlet and an outlet facing the nozzle outlet and the outlet of the compressible insert is of larger diameter than the inlet of the compressible portion. In another embodiment the nozzle incorporates a resiliently compressible folded flange extending radially of the body portion adjacent to the inlet of the nozzle.

3 Claims, 4 Drawing Sheets

FLUID DISPENSING ACCESSORY

This invention relates to a fluid dispensing accessory and more particularly to improvements in nozzles for use with caulking and sealant materials.

BACKGROUND TO THE INVENTION

Caulking materials, bonding fluids, sealants etc are usually sold in a cartridge, with a movable back plate at one end and an outlet at the other end, for use in a caulking gun. The caulking gun includes a cradle for the cartridge and a piston that acts on the movable end wall of the cartridge. The outlet end of the cartridge is secured on the gun by a plate having an opening. A nozzle is attached to the opening in the cartridge and extends through the opening in the front plate of the caulking gun. As the trigger is pressed the piston of the caulking gun advances and presses the movable wall of the cartridge resulting in extrusion of the contents through the cartridge opening and the nozzle.

A problem occurs when pressure is released by the operator releasing the trigger as fluid residues continue to discharge through the outlet and the nozzle. This creates waste and spillages that have to be cleaned up. This adds to the work time and inconvenience for the workman.

This problem of over ejection or drool has been addressed in U.S. Pat. Nos. 4,009,804, 4,572,409, 5,236,105, 5,529,225 and 6,119,903 all of which modify the trigger and piston operation of the caulking gun to produce a backward movement of the piston to retract the material back from the outlet. In practice these solutions have not proved successful.

It is an object of this invention to overcome this problem in an inexpensive and convenient manner.

BRIEF DESCRIPTION OF THE INVENTION

To this end the present invention provides a nozzle for a caulking gun which incorporates a resilient portion that is compressed when the trigger of the caulking gun is actuated and resumes its former shape when the trigger is released to expand the internal volume of the nozzle.

The resilient portion may be a concertina or bellows shape which is initially compressed by the pressure of the material being extruded and which is able to expand when the pressure is reduced so that the material in the nozzle is drawn back into the nozzle from the nozzle outlet. The nozzles are made from synthetic plastic or polymeric material as an integral product in a mould. The polymeric material may be a polyolefine such as polyethylene or poly propylene.

Because the nozzles are inexpensive and can work with any style of caulking gun whether mechanical or pneumatic they provide a more effective solution than the prior art attempts which did not modify the nozzles.

In one embodiment the present invention provides a nozzle which includes a) a hollow body portion having a wide inlet opening and a narrower outlet opening b) a resiliently compressible portion mounted within the body portion having a hollow body which has an inlet facing the nozzle inlet and an outlet facing the nozzle outlet c) the outlet of the compressible portion is of larger diameter than the inlet of the compressible portion.

This arrangement allows an insert to be placed in a conventional nozzle. The insert may be a hollow concertina which is compressed during extrusion as the material is forced against the insert and then passes through it. When the pressure drops due to release of the trigger the resilient concertina expands and draws excess material back from the nozzle outlet.

In another embodiment the present invention provides a nozzle which includes a) a hollow body portion having a wide inlet opening and a narrower outlet opening b) a resiliently compressible folded flange extending radially of the body portion adjacent to the inlet of the nozzle.

In this arrangement the flange is located between the end of the cartridge and the outlet plate of the caulking gun. During extrusion the folded flange is compressed but on release of the trigger the resilience of the material allows the fold to open out increasing the internal volume of the nozzle and withdrawing material back from the nozzle outlet.

The nozzle and the resilient portion may be made from the same polymeric material that is resilient and acts as a spring.

DETAILED DESCRIPTION OF THE INVENTION

Preferred embodiments of the invention will now be described with reference to the drawings in which.

Figure 1:
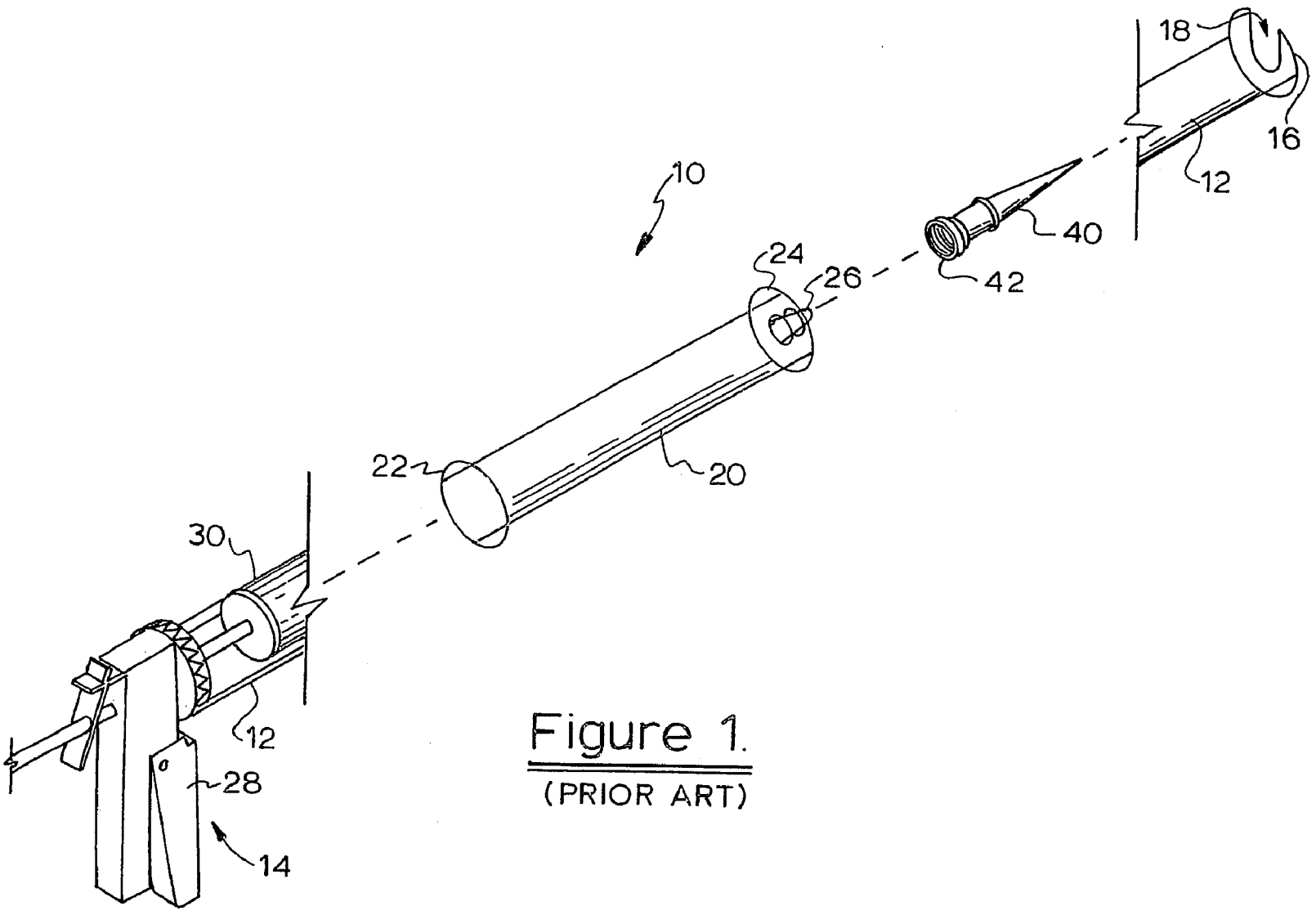
Figure 1. (PRIOR ART)
FIG. 1 is a schematic outline of a caulking gun cartridge and nozzle to which this invention applies.

FIG. 1 illustrates a conventional caulking gun 10 comprising a cradle 12 having a trigger mechanism 14 which includes a trigger 28 and piston 30 which acts on the end wall 22 of the cartridge 20. The outlet end 24 of the cartridge 20 incorporates a nipple 26 and the wall 24 abuts the dispensing end wall 16 of the cradle 12 and the nipple 26 protrudes through the u shaped opening 18 in the end wall 16. A nozzle 40 is usually fastened by way of the screw threaded end 42 onto the nipple 26 so that the nozzle extends through the opening 18. In use the cartridge is filled with sealant caulking compound etc and the piston 30 is forced against the end wall 22 of the cartridge 20 so that the sealant etc extrudes through nipple 26 into nozzle 40 and out the outlet end of the nozzle.

FIGS. 2 to 6 illustrate a first embodiment of the invention in which the nozzle 40 includes a folded radially extending flange 54 adjacent the inlet end 64 of the nozzle 40. The nozzle of FIGS. 2 to 6 incorporates a screw threaded boss 46 which has internal screw threads 42 at the inlet end 64 of the body member 44. Material enters the nozzle 40 through inlet 64 passes through the interior space 66 and the exits through the nozzle dispensing outlet 48. The body member 44 consists of a cylindrical portion 52 joined to a tapered section 50 ending in the dispensing outlet 48. the body member 44 encloses the internal space 66.

The flange portion 54 consists of an end wall 56 circumferentially surrounding the inlet 64 which forms one side of the flange and is joined to the other wall 58 by a bridging section 60. The flange 54 in its relaxed state has an interior space 62 which communicates with the nozzle internal space 66. the nozzle is fitted to the nipple 26 of the cartridge 20 of FIG. 1 so that the flange 54 lies on the cartridge side of the end wall 16 of the cradle so that the flange wall 58 abuts the cradle wall 16 and the nozzle end wall 56 abuts the cartridge end wall 24 and nipple 26 is screwed into boss 46.

The nozzle of FIGS. 2 to 6 may conveniently be manufactured by injection blow moulding.

Figure 3:
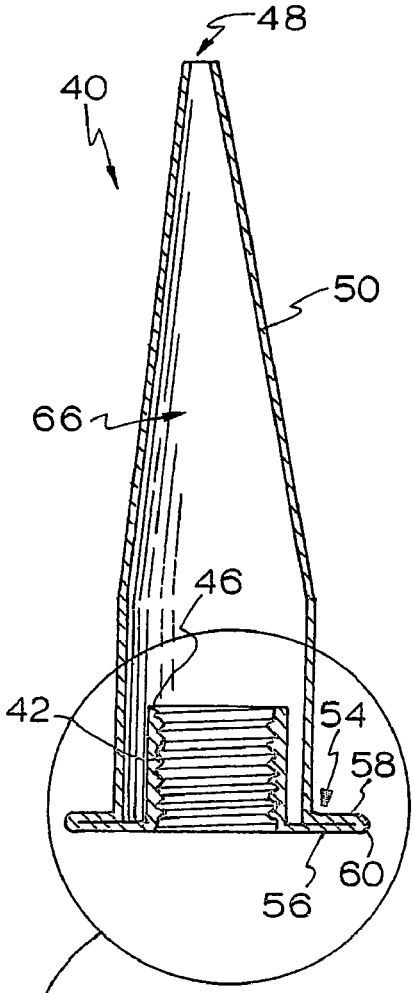
FIG. 3 illustrates the nozzle of FIG. 2 in a compressed state.
Figure 2:
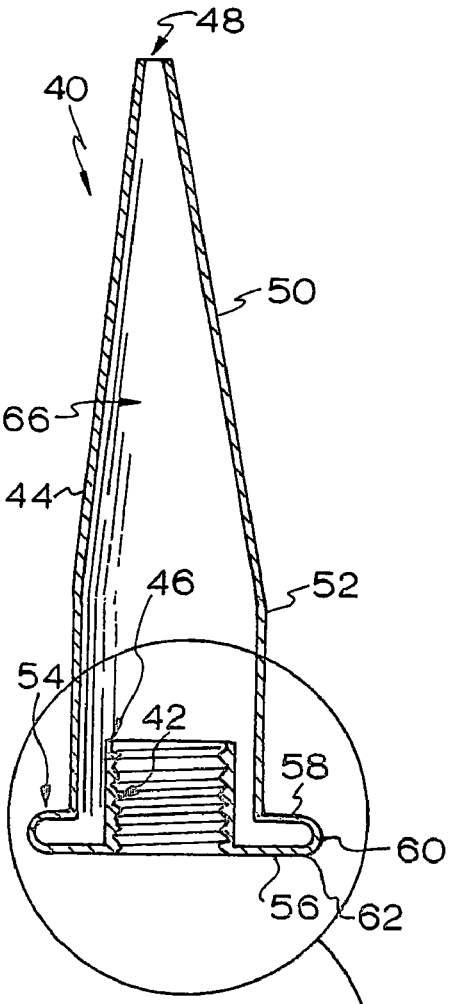
FIG. 2 illustrates a first embodiment of a nozzle in a relaxed state.
Figure 5:
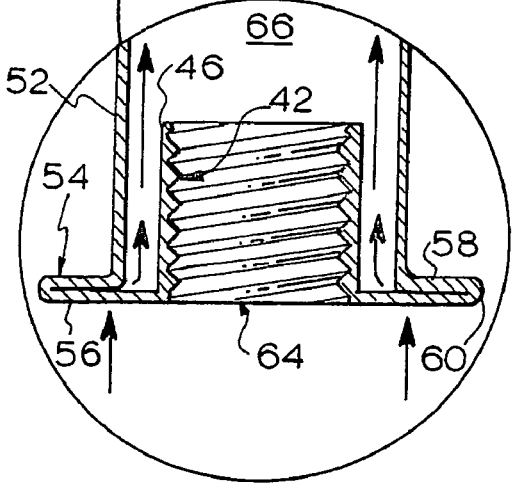
FIG. 5 is a detailed view of FIG. 3.
Figure 6:
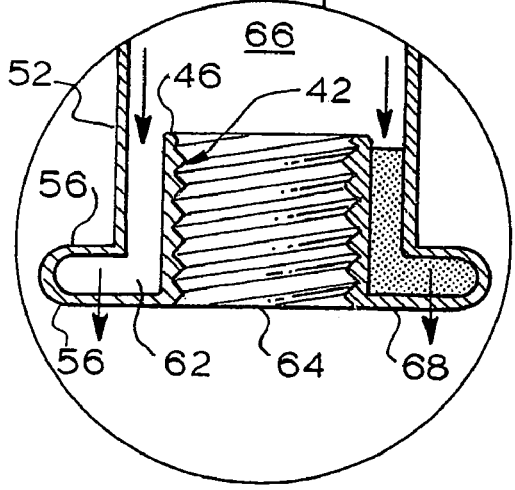
FIG. 6 is a detailed view of FIG. 2.
Figure 4:
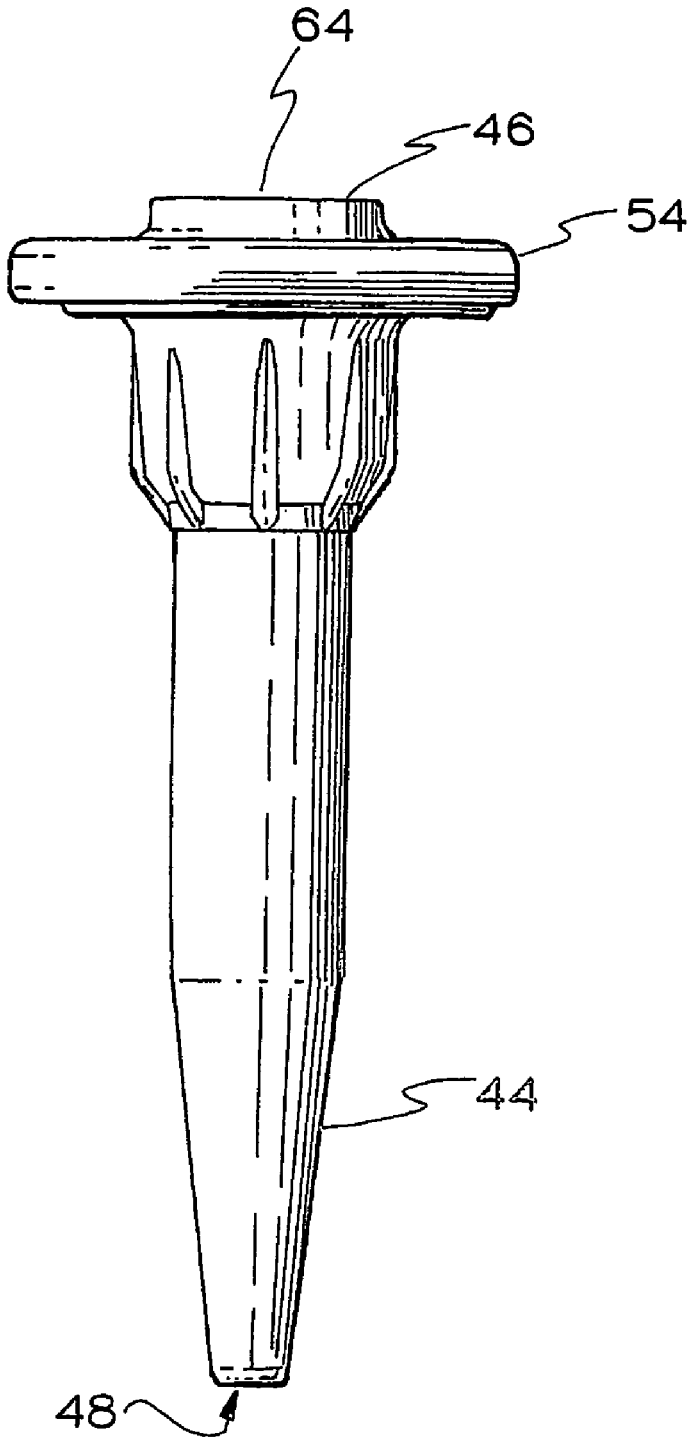
FIG. 4 shows a side elevation of another embodiment of the nozzle of FIG. 2 in a relaxed state.

In use the compression of the trigger of the caulking gun will apply pressure through the cartridge to compress the flange 54 so that the space 62 is reduced in volume as shown in FIG. 3. When the trigger is released and the applied pressure is lowered the resilience of the material in bridging section 60 ensures that walls 56 and 58 spring apart to resume the relaxed state shown in FIG. 2. When this occurs the internal volume of space 66 is increased and the material 68 within space 66 expands into space 62 as shown in FIG. 6. This means that material is impeded from leaking out of the nozzle 48.

Figure 7:
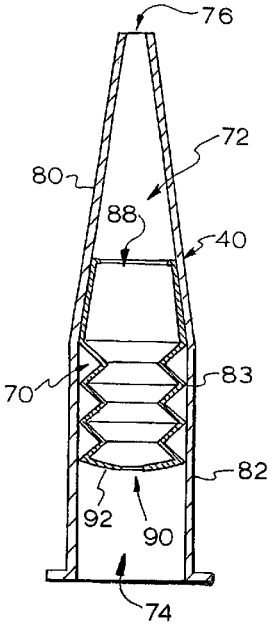
FIG. 7 is a schematic sectional view of a second embodiment of the invention inserted into a conventional nozzle.
Figure 8:
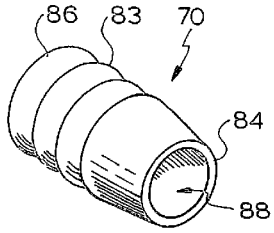
FIG. 8 is a front isometric view of the insert of FIG. 7.
Figure 9:
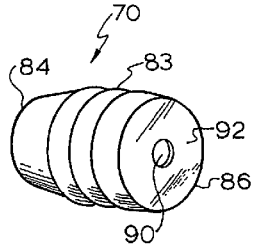
FIG. 9 is a rear isometric view of the insert of FIG. 7.

In the second embodiment of the invention shown in FIGS. 7 to 9 an insert 70 is received within the interior 72 of a conventional nozzle 40 which has a an inlet opening 74 and an outlet 76 which is narrower than inlet opening 74. Insert 70 consists of bellows or concertina shaped resilient polymeric body 83 having an inlet end 86 with an opening 90 surrounded by a bearing surface 92 and an outlet end 84 with an outlet opening 88 that is narrower in diameter than the inlet 90. The insert 70 is positioned within the nozzle 40 so that its inlet end 86 is adjacent the inlet 74 of nozzle 40 and the outlet end 84 of the inset 70 faces the outlet 76 of nozzle 40. When material enters nozzle 40 under pressure it acts on the bearing surface 92 to compress the concertina body 83 and reduce the internal volume of the insert 70. When the extrusion pressure is relaxed with release of the trigger the resilience of the body 83 allows it to resume its relaxed state and increase the internal volume. This enable the material down stream of the insert opening to be withdrawn into insert 70 from the nozzle 40 to prevent drool of the contents.

Both embodiments may be made by injection moulding and the preferred material is polyethylene and in particular a blend of low density polyethylene (LDPE) and high density polyethylene (HDPE).

Thus it can be seen that the present invention provides a unique solution to the problem of drool or over ejection and reduces the mess and clean up time for tradesmen.

It will be appreciated by those skilled in the art that variations and or modifications may be made to the described invention without departing from the core teachings of the invention.

The invention claimed is

1. A nozzle for a caulking gun which includes:

a) a hollow body portion having a wide inlet opening and a narrower outlet, opening that communicates directly with the inlet opening;

b) a folded flange extending radially of the body portion adjacent the inlet of the nozzle and having a single first annular wall oriented transversely of a hollow body axis and circumferentially attached around the inlet opening; and a single second annular wall positioned in uniform spaced coaxial relation with the first wall and joined to the first wall by a bridging section, a normally expanded annular space being created in the interior of the hollow body between the first and second walls when the flange assumes a non-compressed shape; and c) the body portion and flange of the nozzle being formed as an single integral unit, wherein said folded flange is resiliently compressed in response to a caulking gun trigger actuation which pressurizes caulking material flowing through the nozzle; and the flange resumes an initial non-compressed shape when the trigger is released to expand the internal volume of the folded flange and to consequentially decrease pressure of the material in the nozzle thereby preventing secretion of material through the outlet opening of the nozzle upon trigger release.

2. A nozzle as claimed in claim 1 wherein the nozzle is an integrally molded nozzle formed from a resilient polymeric material.

3. A nozzle as claimed in claim 1 together with an internally threaded boss integrally formed with the first wall, one end of the boss forming the nozzle inlet, the boss extending coaxially inward and adapted to fixedly secure a caulking cartridge thereto so as to prevent longitudinal movement of the cartridge during trigger operation of the gun.

* * * * *